US010993557B2

(12) United States Patent
Nardo et al.

(10) Patent No.: US 10,993,557 B2
(45) Date of Patent: May 4, 2021

(54) PRESSURE MANAGEMENT WARMING HEADREST

(71) Applicant: American Sterilizer Company, Mentor, OH (US)

(72) Inventors: Richard P. Nardo, Highland Heights, OH (US); Andrew M. D. Moss, Solon, OH (US)

(73) Assignee: American Sterilizer Company, Mentor, OH (US)

( * ) Notice: Subject to any disclaimer, the term of this patent is extended or adjusted under 35 U.S.C. 154(b) by 191 days.

(21) Appl. No.: 16/054,005

(22) Filed: Aug. 3, 2018

(65) Prior Publication Data

US 2020/0037798 A1 Feb. 6, 2020

(51) Int. Cl.
*A47G 9/10* (2006.01)
*A61G 13/12* (2006.01)

(52) U.S. Cl.
CPC ..... *A47G 9/1036* (2013.01); *A47G 9/10* (2013.01); *A61G 13/121* (2013.01); *A47G 2009/1018* (2013.01); *A61G 2203/46* (2013.01)

(58) Field of Classification Search
CPC ..... A47G 9/10; A47G 9/1036; A47G 2009/1018; A47G 13/121; A47G 2203/46; B60N 2/803; B60N 2/806; B60N 2/879
See application file for complete search history.

(56) References Cited

U.S. PATENT DOCUMENTS 1,402,889 A * 1/1922 Potstada ..... H05B 3/16 338/297
1,439,094 A * 12/1922 Gingras ..... H05B 3/342 219/529
2,473,183 A * 6/1949 Watson ..... H01B 3/30 219/543
3,202,801 A * 8/1965 Saluri ..... H05B 3/342 219/528
4,104,509 A * 8/1978 Van Bokestal ..... H01C 1/02 219/544
4,534,886 A 8/1985 Kraus et al.
4,668,857 A 5/1987 Smuckler
(Continued)

FOREIGN PATENT DOCUMENTS

CA 2136066 A1 11/1993
WO WO-00/00117 A1 1/2000
(Continued)

OTHER PUBLICATIONS

International Search Report and Written Opinion from corresponding International Patent Application No. PCT/US2018/045310 dated Oct. 3, 2018.

(Continued)

*Primary Examiner* — David R Hare
(74) *Attorney, Agent, or Firm* — Kusner & Jaffe

(57) ABSTRACT

A pressure management device with an integrated warming apparatus that provides improvements to pressure management for patients in the supine and side-laying positions, warms a patient's head during surgery; and allows for compact storage. The pressure management device includes a pressure management layer and a heating layer having a heating member that includes a heating element.

26 Claims, 8 Drawing Sheets

(56) References Cited

U.S. PATENT DOCUMENTS 4,777,346 A * 10/1988 Swanton, Jr. ..... A47G 9/1036 219/201
4,822,980 A 4/1989 Carbone et al.
4,868,898 A * 9/1989 Seto ..... A47C 7/748 219/528
5,008,515 A 4/1991 McCormack
5,125,238 A 6/1992 Ragan et al.
5,371,340 A * 12/1994 Stanfield ..... A01K 1/0218 119/28.5
5,413,837 A * 5/1995 Rock ..... A41D 31/02 428/192
5,643,480 A 7/1997 Gustavsson et al.
5,658,325 A 8/1997 Augustine
5,809,573 A 9/1998 Bary
5,835,983 A * 11/1998 McMahen ..... A61F 7/007 219/527
5,932,129 A * 8/1999 Hyatt ..... F28D 20/028 219/528
6,050,265 A * 4/2000 Richardson ..... A61G 7/065 128/845
6,073,284 A 6/2000 Borders
6,078,026 A 6/2000 West
6,093,910 A 7/2000 McClintock et al.
6,149,674 A 11/2000 Borders
6,172,344 B1 1/2001 Gordon et al.
6,194,692 B1 2/2001 Oberle
6,483,087 B2 11/2002 Gardner et al.
6,541,744 B2 4/2003 Von Arx et al.
6,581,400 B2 * 6/2003 Augustine ..... A47G 9/0215 607/107
6,582,456 B1 6/2003 Hand et al.
6,664,512 B2 12/2003 Horey et al.
D485,338 S 1/2004 Augustine et al.
6,706,402 B2 3/2004 Rueckes et al.
6,734,250 B2 5/2004 Azechi et al.
6,781,166 B2 8/2004 Lieber et al.
6,803,543 B2 10/2004 Argersinger et al.
6,814,889 B1 11/2004 O'Grady et al.
6,859,967 B2 3/2005 Harrison et al.
6,912,749 B2 7/2005 Thomas et al.
6,924,467 B2 * 8/2005 Ellis ..... A61F 7/007 219/212
6,967,309 B2 11/2005 Wyatt et al.
6,974,935 B2 12/2005 O'Grady et al.
7,001,416 B2 2/2006 Augustine et al.
7,022,950 B2 4/2006 Haas et al.
7,191,482 B2 3/2007 Romano et al.
7,416,699 B2 8/2008 Dai et al.
7,468,332 B2 12/2008 Avloni
7,543,344 B2 6/2009 Augustine et al.
7,714,255 B2 5/2010 Augustine et al.
7,745,810 B2 6/2010 Rueckes et al.
7,786,408 B2 8/2010 Augustine et al.
7,851,729 B2 12/2010 Augustine et al.
7,967,377 B2 * 6/2011 Truckenbrodt ..... B60N 2/002 297/217.3
8,016,779 B2 9/2011 Brown et al.
8,062,343 B2 11/2011 Augustine et al.
8,153,940 B2 4/2012 Niemz et al.
8,283,602 B2 10/2012 Augustine et al.
8,474,079 B1 * 7/2013 Gangitano ..... A47C 21/048 5/421
8,581,158 B2 11/2013 Heintz et al.
8,624,164 B2 1/2014 Deibel et al.
8,772,676 B2 7/2014 Augustine et al.
9,191,997 B2 11/2015 Weiβ
9,962,122 B2 * 5/2018 Augustine ..... A61F 7/007
10,076,189 B2 * 9/2018 MacDougall ..... B60N 2/882
10,201,240 B1 * 2/2019 Arrighi ..... A47G 9/1054
2002/0133213 A1 * 9/2002 Tippitt ..... A61F 7/007 607/98
2003/0131419 A1 * 7/2003 VanSteenburg .... A61G 7/05715 5/737
2004/0173028 A1 9/2004 Rix
2005/0173414 A1 8/2005 Ishii et al.
2005/0187527 A1 8/2005 Rix
2006/0137099 A1 6/2006 Feher
2007/0013213 A1 * 1/2007 Axinte ..... B60N 2/5685 297/180.12
2007/0093882 A1 4/2007 Anderson et al.
2008/0085944 A1 4/2008 Hirsch
2008/0249447 A1 10/2008 Brown et al.
2009/0000031 A1 1/2009 Feher
2011/0066217 A1 3/2011 Diller et al.
2011/0172750 A1 7/2011 Cassidy
2012/0049586 A1 * 3/2012 Yoshimoto ..... A47C 7/748 297/180.12
2012/0131747 A1 * 5/2012 Sclare ..... A61F 7/02 5/421
2012/0228904 A1 * 9/2012 Mouradian ..... A47C 7/74 297/180.12
2012/0279953 A1 * 11/2012 Augustine ..... A61F 7/007 219/217
2013/0186884 A1 7/2013 Barfuss et al.
2013/0312192 A1 * 11/2013 Lee ..... A47G 9/007 5/639
2014/0041091 A1 * 2/2014 Sternlight ..... B60N 2/885 2/12
2014/0152057 A1 * 6/2014 Truant ..... B60N 2/879 297/180.12
2015/0033474 A1 2/2015 Mikkelsen et al.
2015/0290027 A1 10/2015 Augustine et al.
2015/0327332 A1 11/2015 Augustine et al.
2015/0352988 A1 * 12/2015 Knapp ..... B60N 2/245 297/393
2015/0366367 A1 12/2015 Augustine et al.
2015/0373781 A1 12/2015 Augustine et al.
2016/0066716 A1 * 3/2016 Rao ..... A61F 7/02 5/644
2016/0081846 A1 3/2016 Katzenstein
2016/0143091 A1 5/2016 Augustine et al.
2018/0055252 A1 * 3/2018 Jensen ..... A47G 9/1081

FOREIGN PATENT DOCUMENTS

WO WO-03/086500 A2 10/2003
WO WO-2011/084957 A 7/2011
WO WO-2016/113633 A1 7/2016
WO WO-2017/068416 A1 4/2017
WO WO-2017/216631 A2 12/2017

OTHER PUBLICATIONS

"Operating Room Positioning Products" Catalog, COVIDIEN Company, Jun. 2015.
"PTC thermistor—Positive Temperature Coefficient," The Resister Guide (E-Book), website printout from www.resistorguide.com/ptc-thermistor, printout date May 18, 2017.
"Self-regulating heater," Wikipedia, https://en.wikipedia.org/w/index.php?title=Self-regulating_heater&oldid=723007142, last edited May 31, 2016, printout date May 18, 2017.
"ThermaZone Occipital Rear Head Relief Pad," BraceMart LLC, website printout from www.brace-mart.com/physical-therapy/thermazone-occipital-rear-head-relief-pad/, printout date Jul. 25, 2018.

* cited by examiner

PRESSURE MANAGEMENT WARMING HEADREST

This application claims the benefit of U.S. Provisional Application No. 62/542,964 filed Aug. 9, 2017, which is hereby fully incorporated herein by reference.

FIELD OF THE INVENTION

The present invention relates generally to a pressure management device, and more particularly to a pressure management device with an integrated warming apparatus.

BACKGROUND OF THE INVENTION

It is well known that the back part of the head is at risk for pressure ulcers if the patient is not properly positioned. Therefore, pressure management with respect to surgical headrests often focuses on pressure management for the occiput. There are many existing occiput pressure management devices. Such devices are typically donut-shaped, U-shaped, stepped conformal, and T-shaped; made of materials, including, but not limited to, gel and foam; and sized for pediatric, adult, and bariatric patients. Several existing occipital pressure management devices have a round hole or recess to provide pressure management for the occiput. However, it is believed that the round hole or recess is not best suited to the anatomy of the human head in either the supine or side-laying positions. Accordingly, there are drawbacks to existing surgical headrests with respect to pressure management.

With regard to patient warming, several studies have shown significant heat loss from a patient under anesthetic during surgery (0.25° C. in 15 minutes [Kimberger, O., Resistive Polymer Versus Forced-Air Warming: Comparable Heat Transfer and Core Rewarming Rates in Volunteers, International Anesthesia Research Society, V105, No. 5, November 2008], and 1.6° C. in 60 minutes [Sessler, D. I., Perioperative Heat Balance. Anesthesiology, V92, No. 2, February 2000]). Furthermore, it has been recognized that uncovered head losses for cooler temperatures can account for a large portion of a body's heat loss (50% at −4° C. [Heat Losses From the Human Head, Gerd Froese, Alan C. Burton, Journal of Applied Physiology Published 1 Mar. 1957 Vol. 10 no. 2, 235-241 DOI:]). This is particularly important in neonate and pediatric cases where physiologic thermoregulation of patients and smaller sizes relative to head sizes make it difficult to maintain normothermia [(Archives of Disease in Childhood, (1981 July) Vol. 56, No. 7, pp. 530-4. Journal code: 0372434. E-ISSN: 1468-2044. L-ISSN: 0003-9888. Report No.: NLM-PMC1627361) and (Journal of Pediatric Surgery, (1983 December) Vol. 18, No. 6, pp. 909-13. Journal code: 0052631. ISSN: 0022-3468. L-ISSN: 0022-3468)].

When exposed to a cool environment, a newborn infant responds by nonshivering thermogenesis. The increased heat production is at the expense of body fuel and energy stores. A significant quantity of heat is lost from the head because of its large surface area and the high metabolic activity of the neonatal brain. Studies have been conducted to determine whether dry cranial heat loss can be significantly reduced by covering the head with a highly insulated material, and to determine whether plastic lined head coverings decrease evaporative heat loss. A total of 46 full term and premature infants were studied. Head coverings insulated with material made of olefin and polyester reduced cranial dry heat loss by 73% and 63%. Plastic-lined head coverings reduced evaporative heat loss by 68%. The insulated and lined head coverings proved to be a simple and safe method of effectively reducing dry and evaporative heat loss [https://doi.org/10.1016/50022-3468(83)80045-1].

The hypothalamus region of the brain is the physiological control center for human temperature regulation. Warming of the hypothalamus can actuate the Arterio-venous anastomoses (AVA) causing more blood to flow to the extremities and promote future warming of the patient under anesthesia [Arterio-venous anastomoses in the human skin and their role in temperature control, Temperature (Austin). 2016 January-March; 3(1): 92-103. Published online 2015 Oct. 12]. Furthermore, studies of human anatomy have shown that the most important areas of the head to warm are the vascular region of the neck, sides, and the back of the head.

Moreover, it has also been observed that the operating room is a crowded environment with minimal storage space. Many existing pressure management devices are bulky and can take up a considerable amount of storage space. For example, foam-based pressure management devices are typically stored in cardboard boxes that take up significant amounts of limited storage space.

In view of the foregoing, there is a need for a pressure management device that provides improvements to pressure management for patients in the supine and side-laying positions; warms a patient's head during surgery; and allows for compact storage.

The present invention provides a pressure management device with an integrated warming apparatus that overcomes drawbacks of prior art surgical headrests.

SUMMARY OF THE INVENTION

In accordance with the present invention, there is provided a pressure management warming headrest comprising a spacer layer; a heating layer including a heating member having a heating element; and a pressure management layer comprised of at least one foam layer, wherein said spacer layer, heating layer and pressure management layer are bonded together.

In accordance with the present invention, there is provided a pressure management warming headrest system comprising: a pressure management warming headrest and a controller for controlling operation of the pressure management warming headrest. The pressure management warming headrest comprises a spacer layer, a heating layer including a heating member having a heating element, and a pressure management layer comprised of at least one foam layer, wherein said spacer layer, heating layer and pressure management layer are bonded together.

An advantage of the present invention is the provision of a pressure management warming headrest that combines a pressure management device with an integrated warming apparatus.

Another advantage of the present invention is the provision of a pressure management warming headrest that accommodates patients in both supine and side-laying positions.

Another advantage of the present invention is the provision of a pressure management warming headrest that provides convective warming of a patient.

Still another advantage of the present invention is the provision of a pressure management warming headrest that can be stored in a minimal volume storage package.

Still another advantage of the present invention is the provision of a pressure management warming headrest that can be easily adapted to a size accommodating bariatric, adult, pediatric, and neonatal patients.

These and other advantages will become apparent from the following description of illustrated embodiments taken together with the accompanying drawings and the appended claims.

BRIEF DESCRIPTION OF THE DRAWINGS

The invention may take physical form in certain parts and arrangement of parts, an embodiment of which will be described in detail in the specification and illustrated in the accompanying drawings which form a part hereof, and wherein.

DETAILED DESCRIPTION OF THE INVENTION

Figure 1:
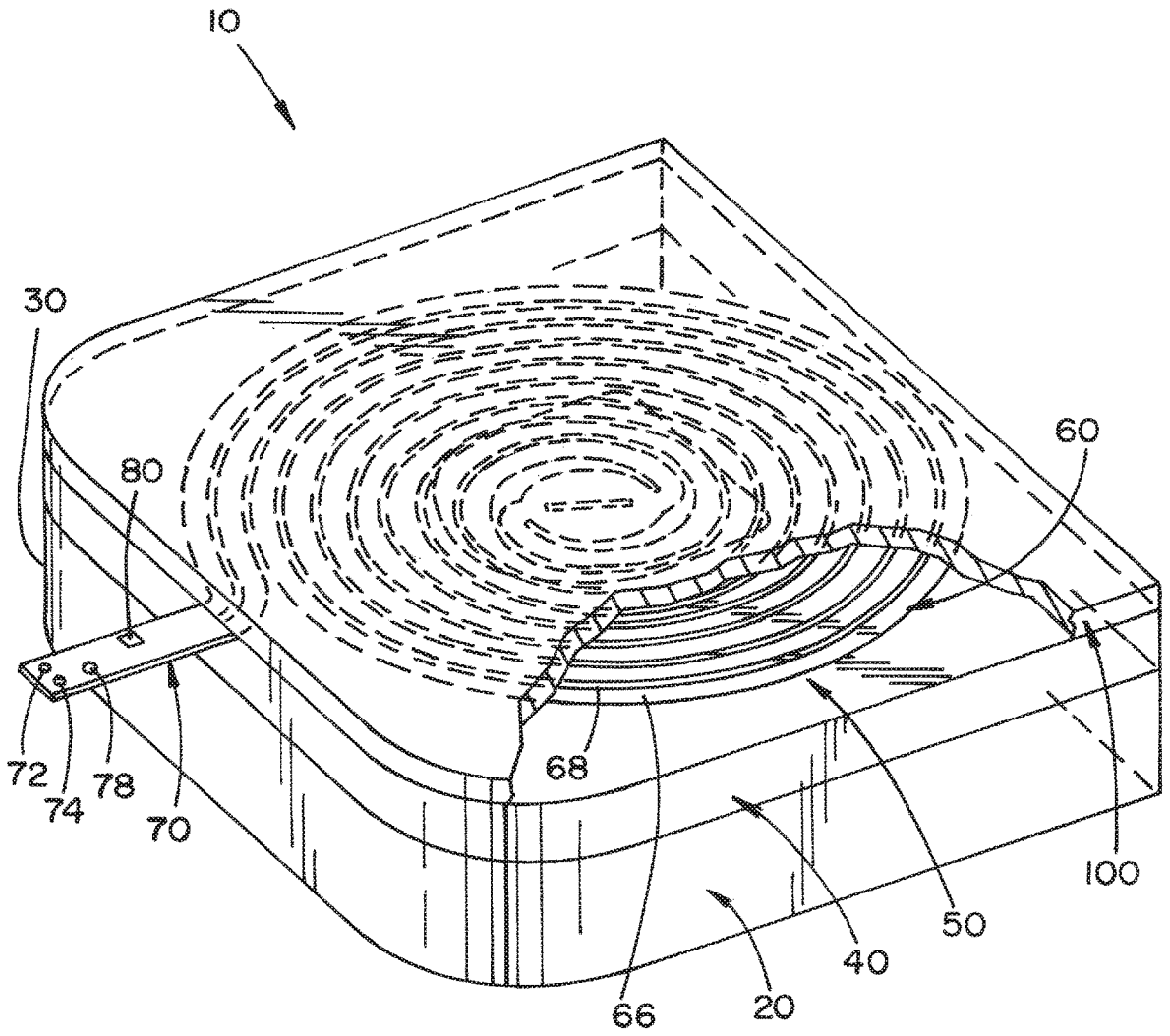
FIG. 1 is a top perspective view of a pressure management warming headrest (PMWH), according to an embodiment of the present invention.
Figure 2:
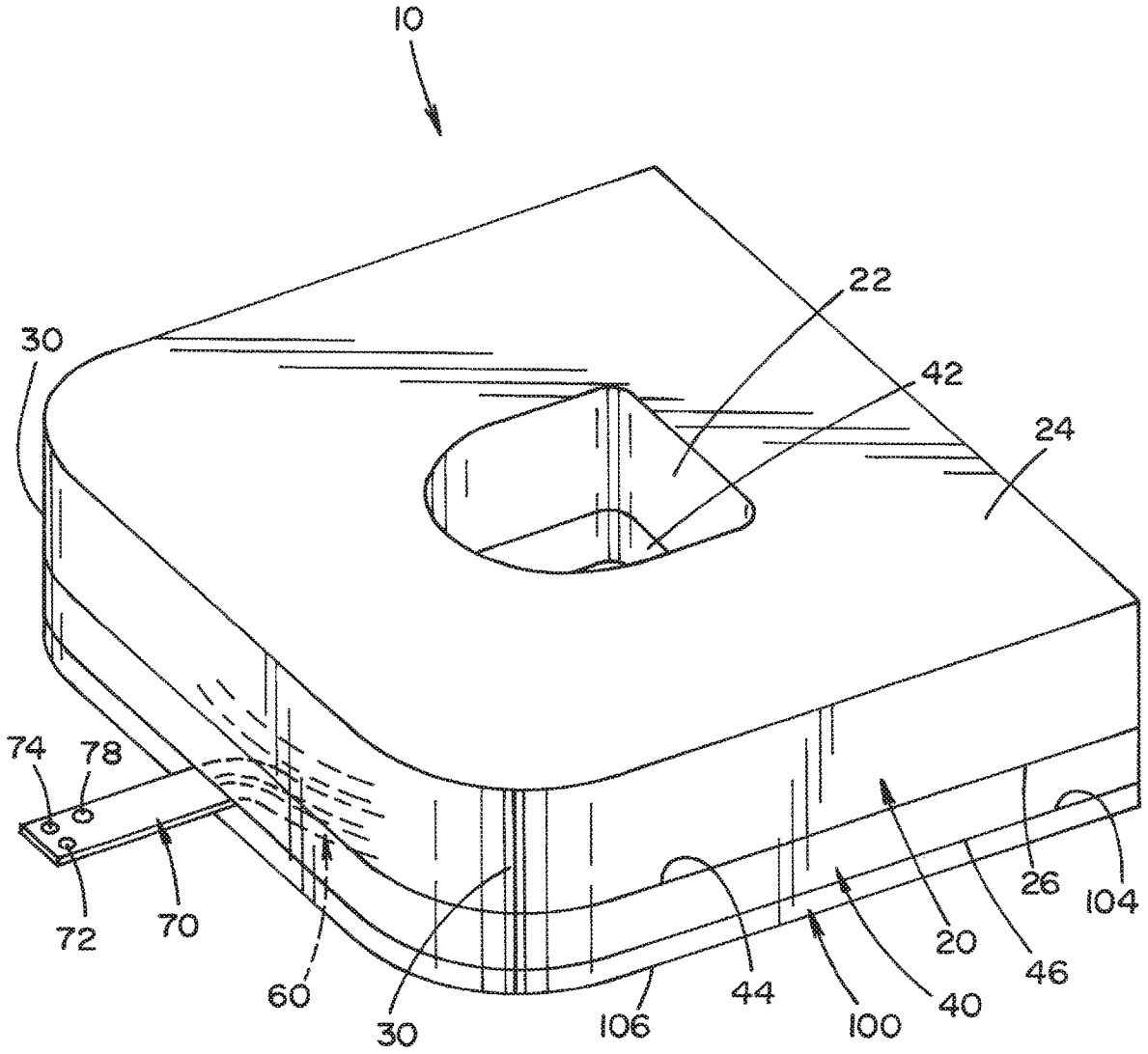
FIG. 2 is bottom perspective view of the PMWH shown in FIG. 1.

Referring now to the drawings wherein the showings are for the purpose of illustrating embodiment(s) of the invention only and not for the purposes of limiting same, FIGS. 1-5 show a pressure management warming headrest (PMWH) 10 according to an embodiment of the present invention. In the illustrated embodiment, PMWH 10 is generally comprised of a high density (HD) foam layer 20, a low density (LD) foam layer 40, a heating layer 50, a spacer layer 100, and a head cover 120. It should be noted that head cover 120 is omitted from FIGS. 1, 2 and 5 for greater clarity. PMWH 10 is a component of a PMWH system 5 shown in FIG. 3.

Figure 5:
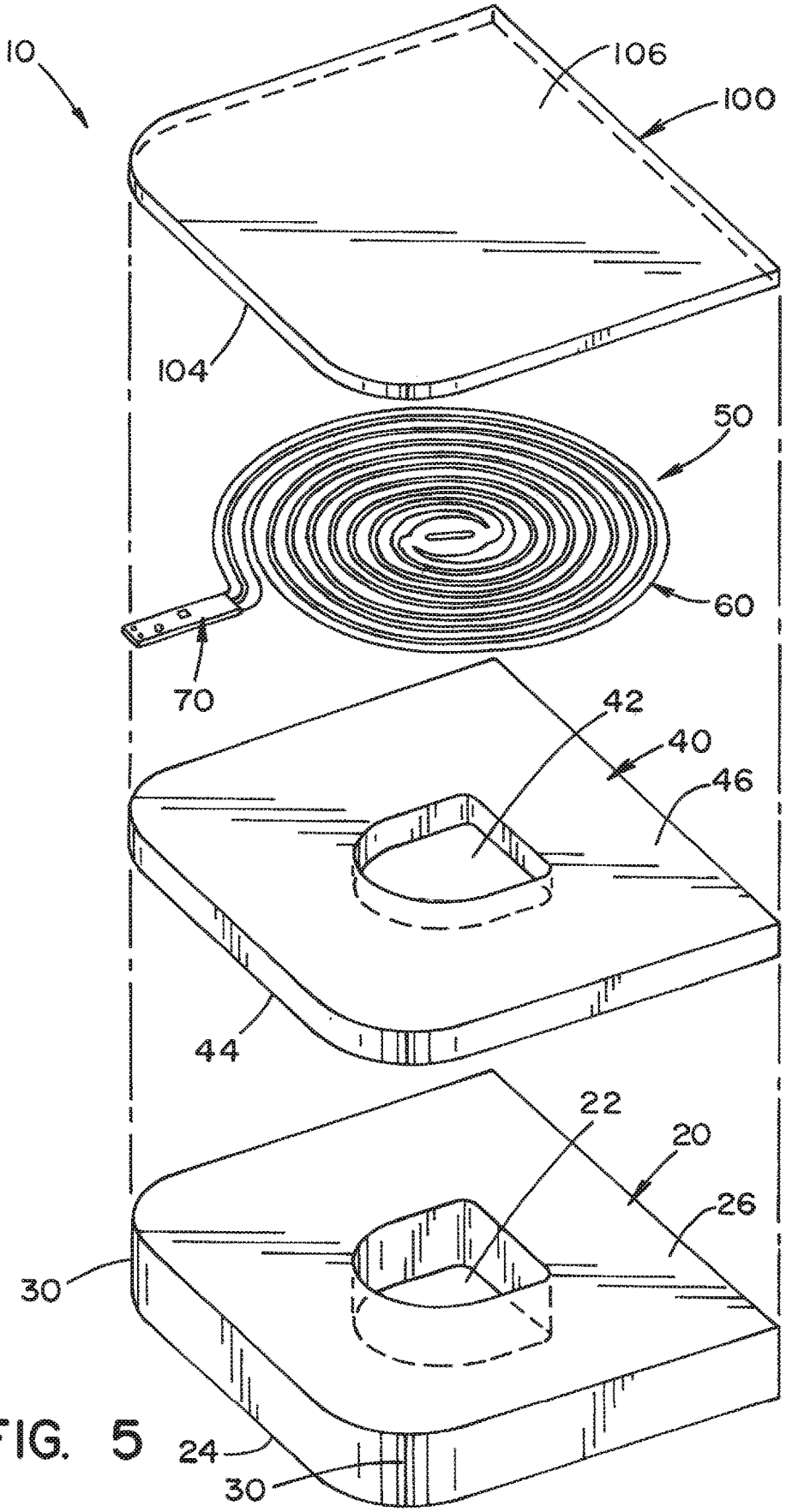
FIG. 5 is an exploded view of the PMWH shown in FIG. 1.

HD foam layer 20 has a central opening 22, a lower surface 24, and an upper surface 26, as best seen in FIG. 5. In one embodiment of the present invention, HD foam layer 20 takes the form of a high density polyurethane foam, such as 2-inch thick SENL polyether polyurethane foam from William T. Burnett & Co. having a density of 2+/−10% lbs/ft$^3$ and an indentation load deflection (ILD) of 26 lbs/50 in$^2$ to 35 lbs/50 in$^2$. According to the illustrated embodiment, rear corners 30 of HD foam layer 20 are curved to accommodate head cover 120, described below. For example, rear corners 30 may be a curved surface defined by a radius of 63.5 mm.

Figure 6:
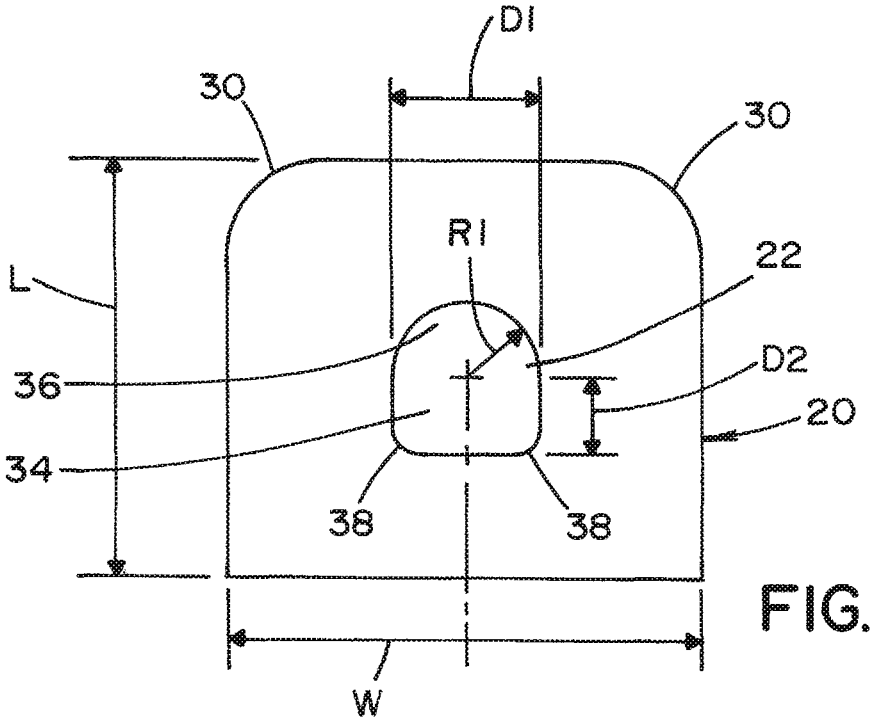
FIG. 6 is a top plan view of a high density (HD) foam layer of the PMWH shown in FIG. 1.
Figure 7:
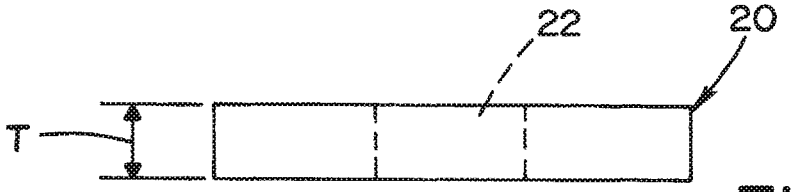
FIG. 7 is a side plan view of the high density (HD) foam layer of the PMWH shown in FIG. 1.

Referring now to FIGS. 6 and 7, exemplary dimensions for an illustrated embodiment of HD foam layer 20 will be discussed. In the illustrated embodiment, opening 22 is comprised of a substantially rectangular region 34 and a semi-circular region 36. As shown in FIG. 6, rectangular region 34 is defined, in part, by a pair of curved surfaces 38. For example, curved surfaces 38 may be defined by a radius of 19.1 mm. Exemplary dimensions for the illustrated embodiment are as follows:

D1=101.6 mm
D2=50.8 mm
R1 (radius)=50.8 mm
L (length)=279.4 mm
W (width)=317.5 mm
T (thickness)=50.8 mm The dimensions for opening 22 are preferably selected to facilitate superior pressure management for patients oriented on PMWH 10 in both supine and side-laying positions.

LD foam layer 40, according to an embodiment of the present invention, has a central opening 42, a lower surface 44, and an upper surface 46. In one embodiment of the present invention, LD foam layer 40 takes the form of a low density polyurethane foam, such as Flexible Foam Products (#10030) 1-inch thick 100% open cell polyurethane foam having a density of 0.9-1 lbs/ft$^3$ and an indentation load deflection (ILD) of 25 lbs/50 in$^2$ to 35 lbs/50 in$^2$. In the illustrated embodiment, LD foam layer 40 has substantially the same shape and dimensions as HD foam layer 20, except thickness T is reduced.

HD foam layer 20 and LD foam layer 40, in combination, provide a pressure management layer for PMWH 10. In accordance with contemplated alternative embodiments of the present invention, the pressure management layer may be comprised of one or more foam layers.

Heating layer 50 is generally comprised of a flexible heating member 60 and a connector interface 70, as best seen in FIGS. 1 and 5. According to an embodiment of the present invention, flexible heating member 60 is comprised of a heating element in the form of a conductive material that is applied to a flexible substrate (e.g., polyester (PET), polyimide (PI), polycarbonate (PC), and thermoplastic polyurethanes (TPU)). The flexible substrate provides support for the heating element and serves as a dielectric. In one embodiment of the present invention, the heating element is sandwiched between a pair of the flexible substrates. The heating element may be applied to the flexible substrate by a screen printing process or other well-known fluid deposition processes, such as gravure/flexographic, ink jet, controlled spray, and the like. In the illustrated embodiment, the flexible substrate is a PET substrate having a thickness in the range of 0.003 inch to 0.010 inch.

In accordance with one embodiment of the present invention, the heating element takes the form of a positive temperature coefficient (PTC) material (e.g., a PTC heating film or PTC thermistor). A PTC heating element is typically made with a thermoplastic PTC carbon ink. A PTC heating element is a self-regulating heating element because as the PTC heating element warms up, its resistance increases (i.e., conductivity decreases), thereby reducing power. Accordingly, a PTC heating element is capable of regulating its temperature without any outside controls. The PTC heating element is preferably configured with a watt density (watts/area) such that the size of the heating element provides a thermal flux that matches the heat loss of a patient.

In one exemplary embodiment of the present invention, heating member 60 is comprised of a heating element applied to a PET substrate (e.g., having a thickness of 0.003 inch). The heating element takes the form of a layer of conductive particles. The conductive particles may be applied to the substrate by processes such as screen printing, gravure/flexographic, ink jet, controlled spray, and the like. The conductive particles can take several forms, including, but not limited to, carbon ink (e.g., Engineered Conductive Materials CI-2002 Series), carbon nanotube, graphite, and a carbon-based PTC resistor paste (PTC ink), such as DuPont 7292 PTC Carbon Resister. It should be appreciated that use of a PTC ink provides a safety benefit by allowing PMWH 10 to have a resistance magnification effect at 45° C. which is the desired heating temperature for spacer layer 100 to achieve a desired 39° C. patient surface contact temperature. Furthermore, carbon is a desirable material since it allows for radiolucency.

In one embodiment of the present invention, heating member 60 also includes a silver bus bar of interdigitated fingers to bring current to the PTC carbon resistor ink that serves as the heating element. The silver bus bar is formed on the substrate by screen printing.

Figure 8:
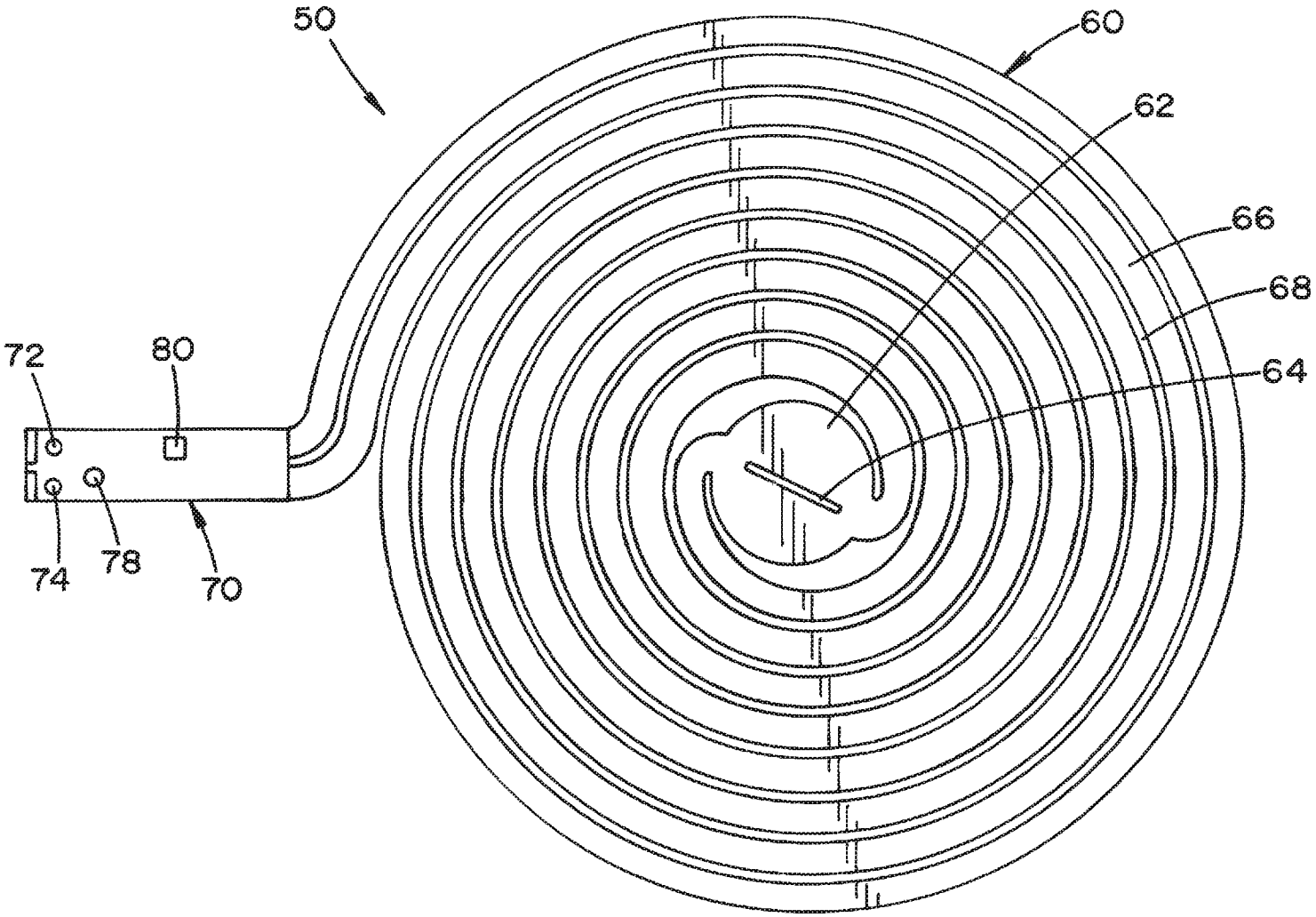
FIG. 8 is a top plan view of a heating layer of the PMWH shown in FIG. 1.

After the process of applying the PTC ink is completed, heating member 60 is silkscreened for labelling, and die-cut using a steel-ruled die (or alternatively a laser, a water jet, or the like) to form a spiral 66 for pressure management, as best seen in FIG. 8. Spiral 66 has a corresponding gap 68 (e.g., approximately 2 mm). The die cutting also forms a circular center disk 62 having a slit 64 (e.g., 1 inch) for additional pressure management. Slit 64 preferably extends along the direction of the electron path, as shown in FIG. 8. However, slit 64 may be oriented orthogonal to the electron path with perforations in the heating element to control undesirable electron flow. It should be appreciated that die-cutting heating member 60 in the manner described above allows the other layers of PMWH 10 to move, thereby reducing pressure on the patient's tissues.

In accordance with an alternative embodiment of the present invention, it is contemplated that slit 64 may be replaced with a hole, thereby making center disk 62 ring-shaped.

As illustrated, the spiral configuration preferably has a double start helix so that positive and negative terminal connections can be provided at a peripheral outer exposed end of heating member 60 for easier connection with a controller. This configuration also eliminates the need to locate copper connecting wires within an X-ray zone.

To be a low heat transfer device in accordance with ISA Standard IEC80601-2-35, it is desirable to have a heating element density (Watts/area) that is less than 115 W/m$^2$. In the illustrated embodiment, the total heating area of heating element is 0.055 m$^2$. Therefore, wattage is 6.325 W for this embodiment of the present invention. The wattage of heating member 60 according to an embodiment of the present invention may be in the range of about 5 W to 45 W.

While heating member 60 has been described herein with respect to a PTC heating element, it is contemplated that other types of heating elements, including those that are not self-regulating may be implemented in connection with the present invention. Furthermore, it is contemplated that according to alternative embodiments of the present invention heating member 60 may be die-cut into forms other than the illustrated spiral shape.

Figure 9:
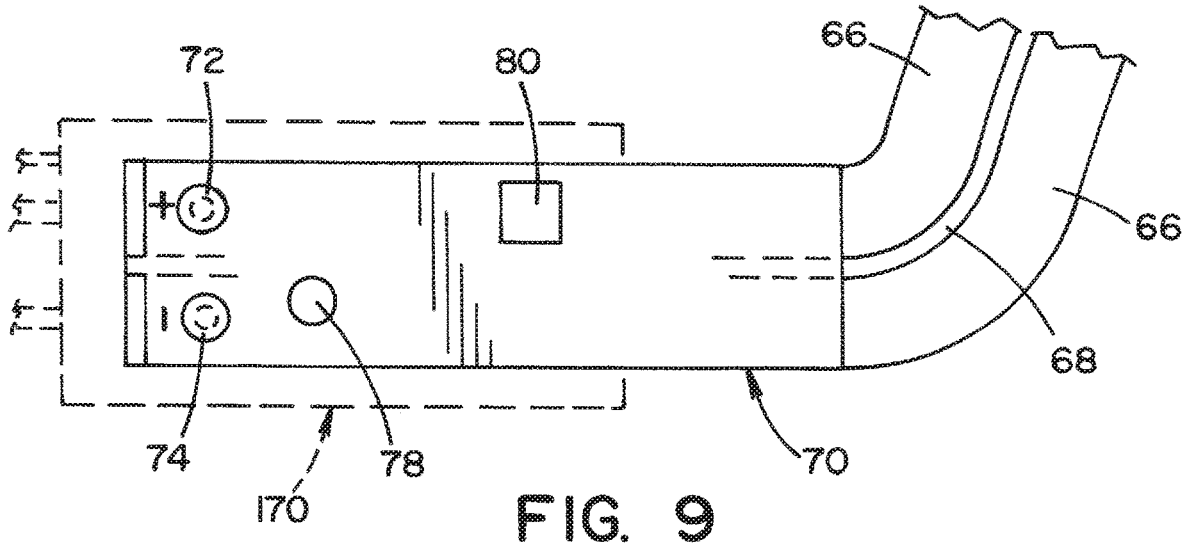
FIG. 9 is an enlarged view of a connector interface of the heating layer shown in FIG. 8, as coupled with a controller cable interface according to an embodiment of the present invention.

Connector interface 70 of heating layer 50 will now be described with particular reference to FIGS. 8 and 9. Connector interface 70 is comprised of a conductive layer (e.g., silver) sandwiched between two flexible substrates. The conductive layer is electrically connected with the heating element of heating member 60. The substrates may be formed of the same material as the substrates described above in connection with heating member 60 (e.g., PET).

Holes (e.g., 2 mm) are formed in the substrates and conductive layer to receive positive and negative terminals 72, 74. In an illustrated embodiment of the present invention, positive and negative terminals 72, 74 take the form of studs or snaps that are crimped onto the holes. It is contemplated that terminals 72, 74 may take other forms, including, alligator clips or CrimpFlex™ contacts that are crimped through the PET substrate into the conductive inks forming the conductive layer.

Connector interface also includes an alignment hole 78 (e.g., 5 mm) and a thermal pad 80 which serves as a proxy for the temperature of the heating element of heating member 60. In one embodiment of the present invention, thermal pad 80 takes the form of screen printed carbon and silver sandwiched by dielectric substrates. To serve as the proxy for the temperature of the heating element, the area of thermal pad 80 is selected to have substantially the same thermal wattage density as the heating area of the heating element. Therefore, a costly temperature sensor does not need to be an integral component of PMWH 10, thereby making PMWH 10 less costly to implement as a disposable article. In an illustrated embodiment, thermal pad 80 is a square having side dimensions of 5-6 mm.

Spacer layer 100, functioning as a comfort layer, includes a lower surface 104 and an upper surface 106. According to an embodiment of the present invention, spacer layer 100 is formed of a spacer fabric, such as Muller Textil GmbH 3Mesh® three-dimensional spacer knit fabric T6010-1000 or 3Mesh® three-dimensional spacer knit fabric T5975-1000. The spacer fabric provides pressure immersion and comfort to the touch. In one embodiment of the invention, spacer layer 100 has a thickness of approximately 10 mm, but can be increased to allow for better pressure management. While an increased layer thickness increases thermal resistance, this can be accommodated by increasing the power to heating member 60 to allow for the same resultant patient contact temperature. 3Mesh® spacer fabric has a substantially consistent temperature with a drop of (0.25 C) for both the compressed and uncompressed state. In the illustrated embodiment, spacer layer 100 has substantially the same shape and dimensions as HD foam layer 20, except thickness T is reduced and a central opening is omitted.

It should be understood that HD foam layer 20, LD foam layer 40, heating layer 50 and spacer layer 100 are bonded to each other by use an adhesive, such as SIMALFA® water-based adhesive, 3M™ Super77™ multipurpose spray adhesive, or Claire® Mist Adhesive. Accordingly, thin layers of adhesive (not shown) are located between these layers. It should be appreciated that the adhesive may be applied to all or only portions of the layer surfaces.

Figure 3:
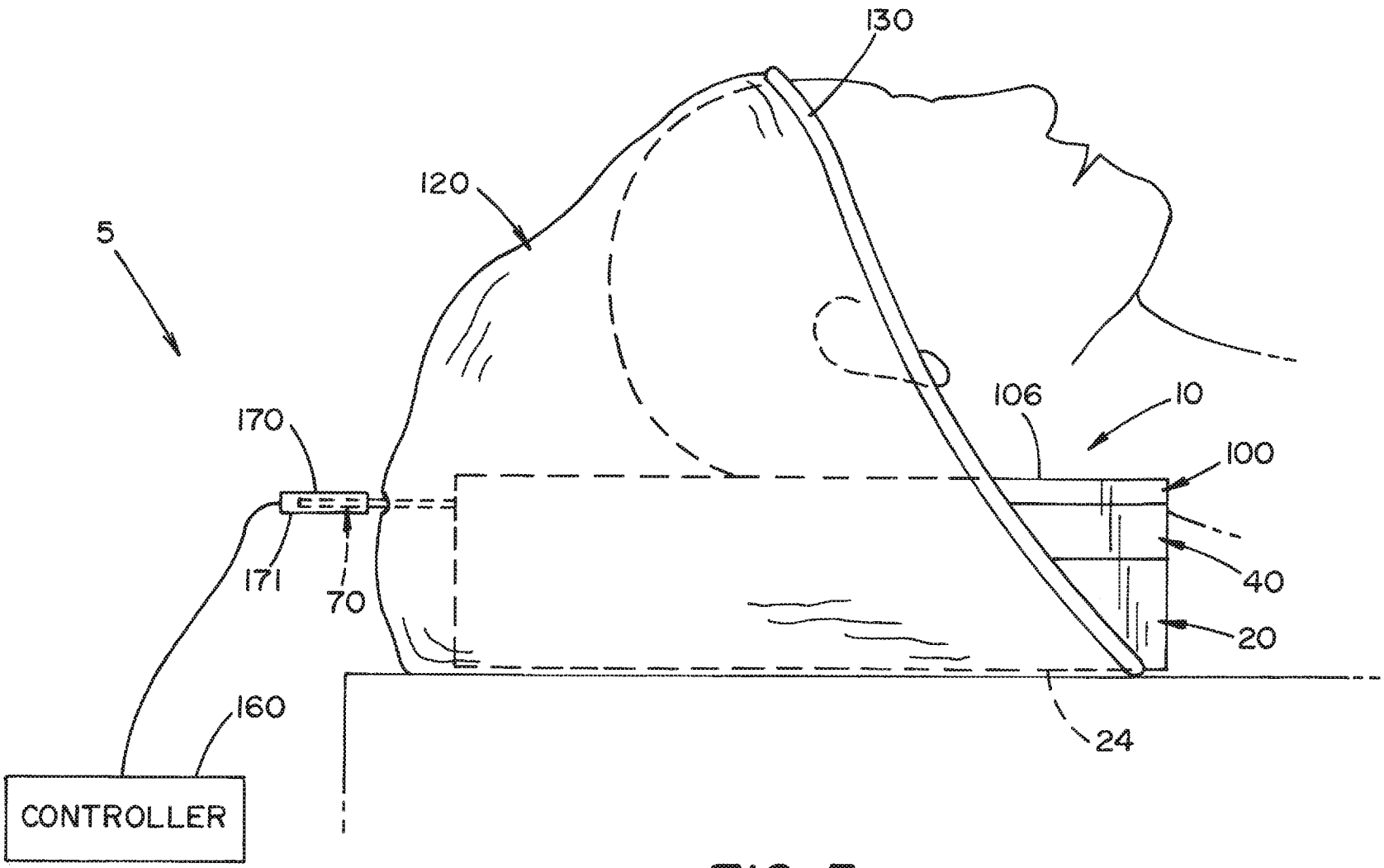
FIG. 3 shows the PMWH of FIG. 1 as part of a PMWH system according to an embodiment of the present invention.
Figure 4:
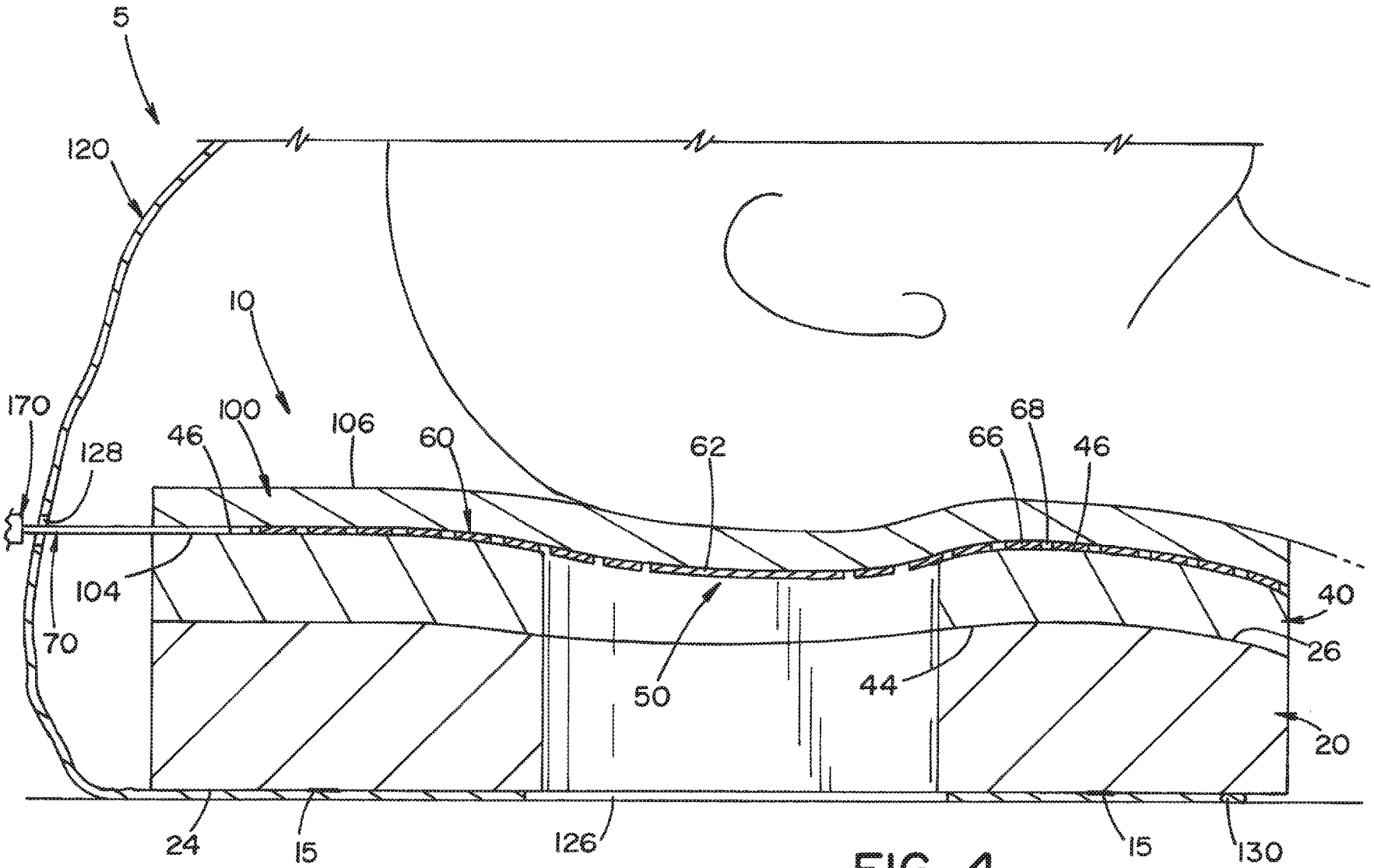
FIG. 4 is a cross-sectional view of the PMWH, as shown in FIG. 3.

Head cover 120 will now be described with reference to FIGS. 3 and 4. In the illustrated embodiment, head cover 120 is made of a lightweight, non-woven material such as an air-laid non-woven material. Air-laid non-woven materials are preferable since they are more thermally resistive than carded non-woven materials. A 5 mil air-laid polyolefin fabric provides a thermal resistance of approximately 0.32 R ([M$^2$K]/W) which optimizes the insulation value based on the maximum desired thickness of the non-woven material. Head cover 120 is stretched over a patient's head to capture and trap convective warming heat. Other suitable materials for head cover 120 include olefin and polypropylene.

In one embodiment of the present invention, the flat pattern unsewn shape of head cover 120 is circular with a diameter of 36 inches. Head cover 120 includes an elastic gather 130 stitched into the round edge to keep it gathered around a patient's face. Elastic gather 130 is lightly stretched during the sewing process for a finished size of 5 to 6 inches diameter when relaxed. The inner surface of head cover 120 is attached to lower surface 24 of HD foam layer 20 using an adhesive 15, as illustrated in FIG. 4. The adhesive may be the same as the adhesive used for bonding together HD foam layer 20, LD foam layer 40, heating layer 50, and spacer layer 100.

It is contemplated in accordance with an alternative embodiment of the present invention that elastic gather 130 may be replaced or supplemented with a repositionable, biocompatible adhesive bonded onto a plastic film. The adhesive allows the head cover to stick to a region surrounding the patient's face.

Head cover 120 includes a hole 126 and a slit 128. Hole 126 aligns with the central opening 22 of HD foam layer 20. This allows the head cover 120 to be stuffed into central opening 22 for packaging and shipping. Since PMWH 10 is typically placed on a foam table pad for usage there is negligible heat loss through hole 126. Slit 128 provides an opening that allows connector interface 70 to pass through head cover 120 for connection with controller cable interface 170.

PMWH 10 may be compressed for compact storage by vacuum packing. In this regard, air may be removed from the foam layers to reduce volume.

Controller 160 is a conventional processing device programmed to control operation of PMWH 10. In one embodiment of the present invention, controller 160 may take the form of a control unit running an open loop at 36V designed to a self-regulating 39° C. max, at an ambient temperature of 22° C. Accordingly, the voltage delivered to the heating element is 36V with a desired temperature up to 39° C. An open loop controller may drive a PTC ink heating element with a corresponding pulse width modulation (PWM) duty cycle to obtain a desired operating temperature, as selected at controller 160 (e.g., 35° C., 36° C., 37° C. 38° C., or 39° C.). For example, a 20% PWM duty cycle may achieve a temperature of 35° C., while a 90% PWM duty cycle may achieve a temperature of 39° C. It is also contemplated that temperature sensor 180 of controller cable interface 170 could be used to drive the heating element in a closed loop fashion.

Figure 10:
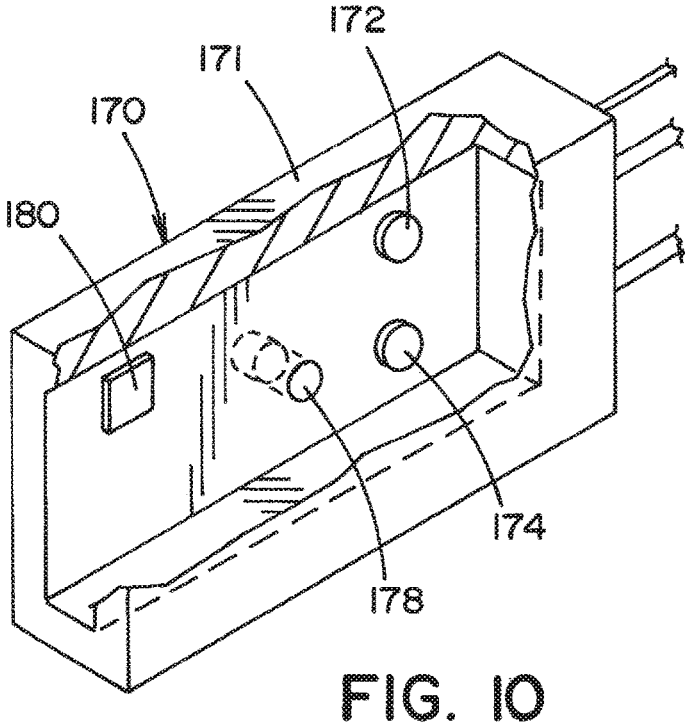
FIG. 10 is a perspective view of the controller cable interface of the PWMH system shown in FIG. 3.

Controller 160 includes a connecting cable having a controller cable interface 170, as shown in FIG. 10. Controller cable interface 170 includes an insulated housing 171 having a recess dimensioned to receive connector interface 70 of heating layer 50. Controller cable interface 170 also includes positive and negative contacts 172, 174, alignment pin 178, and a temperature sensor 180. Positive and negative contacts 172, 174 respectively engage with positive and negative terminals 72, 74 of connector interface 70. Alignment pin 178 is dimensioned to be received in alignment hole 78 to align and secure connector interface 70 to controller cable interface 170. Temperature sensor 180 is aligned with thermal pad 80 to sense the temperature of thermal pad 80 in order to determine the temperature of heating member 60. For example, temperature sensor 180 may take the form of a thermocouple, a thermistor, or a resistance temperature detector (RTD). Temperature sensor 180 functions as a safety backup for the self-regulating heating element of heating member 60. Accordingly, temperature sensor 180 ensures that a maximum allowable temperature is not exceeded. While controller 160 is shown herein as an external device to PMWH 10, it is also contemplated that controller 160 may be integrated into PMWH 10 to form a non-disposable PMWH 10.

It should be appreciated that PMWH 10 as shown and described herein is disclosed solely for the purpose of illustrating an embodiment of the present invention and not for limiting same. It is contemplated that alternative configurations, shapes, dimensions, and materials may be substituted for those disclosed herein without departing from the present invention. For example, alternative materials for the foam layers include, but are not limited to, elastic foam, viscoelastic foam, gel, air cells, gel, viscous fluid, water, and wool. Examples of alternative shapes include, but are not limited to, donut-shaped, U-shaped, stepped conformal, and T-shaped. Dimensions of the present invention may be adapted to accommodate bariatric, adult, pediatric, and neonatal patients. Furthermore, it is contemplated that PMWH 10 may be adapted to support portions of a patient's body other than the head.

Other modifications and alterations will occur to others upon their reading and understanding of the specification. It is intended that all such modifications and alterations be included insofar as they come within the scope of the invention as claimed or the equivalents thereof.

Having described the invention, the following is claimed:

1. A pressure management warming headrest, comprising:

a spacer layer configured to contact a user's head;

a heating layer including a heating member having a heating element; and a pressure management layer through which a central opening extends, the central opening being defined by the pressure management layer, the pressure management layer being comprised of at least one foam layer, wherein said heating layer is disposed between said spacer layer and said central opening, wherein said heating layer is in contact with said spacer layer and said pressure management layer, and wherein said spacer layer, said heating layer, and said pressure management layer are secured together.

2. The headrest according to claim 1, wherein the heating element is a self-regulating heating element.

3. The headrest according to claim 1, wherein the pressure management layer is comprised of first and second foam layers, said first foam layer being a high density foam layer and said second foam layer being a low density foam layer.

4. The headrest according to claim 1, wherein the heating layer forms a spiral.

5. The headrest according claim 1, wherein the heating member includes at least one substrate.

6. The headrest according to claim 1, wherein the heating layer further comprises a connector interface electrically connected to the heating element.

7. The headrest according to claim 6, wherein the connector interface includes a thermal pad having a watt density equal to a watt density of a heating area of the heating element.

8. The headrest according to claim 1, wherein the spacer layer is comprised of a three-dimensional spacer knit fabric.

9. The headrest according to claim 1, wherein the central opening is defined as a rectangular region and a semicircular region by the pressure management layer.

10. The headrest according to claim 1, wherein the headrest further comprises an adhesive for securing the spacer layer, the heating layer, and the pressure management layer together.

11. The headrest according to claim 1, wherein the headrest further comprises a head cover attached to the pressure management layer.

12. The headrest according to claim 11, wherein the head cover is formed of an air-laid non-woven material.

13. A pressure management warming headrest system, comprising:

a pressure management warming headrest, including:

a spacer layer configured to contact a user's head;

a heating layer including a heating member having a heating element; and a pressure management layer through which a central opening extends, the central opening being defined by the pressure management layer and the heating layer, the pressure management layer being comprised of at least one foam layer; and a controller for controlling operation of the pressure management warming headrest, wherein the heating layer is disposed between said spacer layer and said central opening, wherein said heating layer is in contact with said spacer layer and said pressure management layer, and wherein said spacer layer, said heating layer, and said pressure management layer are secured together.

14. The system according to claim 13, wherein the heating element is a self-regulating heating element.

15. The system according to claim 13, wherein the pressure management layer is comprised of first and second foam layers, said first foam layer being a high density foam layer and said second foam layer being a low density foam layer.

16. The system according to claim 13, wherein the heating layer forms a spiral.

17. The system according to claim 13, wherein the heating member includes at least one substrate.

18. The system according to claim 13, wherein the heating layer further comprises a connector interface electrically connected to the heating element.

19. The system according to claim 18, wherein the connector interface includes a thermal pad having a watt density that is equal to a watt density of a heating area of the heating element.

20. The system according to claim 19, wherein said system further comprises a controller cable interface for electrically connecting pressure management warming headrest to the controller.

21. The system according to claim 20, wherein the controller cable interface includes a temperature sensor for sensing the temperature of the thermal pad.

22. The system according to claim 13, wherein the spacer layer is comprised of a three-dimensional spacer knit fabric.

23. The system according to claim 13, wherein said central opening is defined as a rectangular region and a semicircular region by the pressure management layer.

24. The system according to claim 13, wherein the pressure management warming headrest further comprises an adhesive for securing the spacer layer, the heating layer, and the pressure management layer together.

25. The system according to claim 13, wherein the pressure management warming headrest further comprises a head cover attached to the pressure management layer.

26. The system according to claim 25, wherein the head cover is formed of an air-laid non-woven material.

* * * * *